US010316627B2

(12) United States Patent
Brisco et al.

(10) Patent No.: US 10,316,627 B2
(45) Date of Patent: Jun. 11, 2019

(54) ASSEMBLY AND METHOD FOR CREATING AN EXPANDED TUBULAR ELEMENT IN A BOREHOLE

(71) Applicant: SHELL OIL COMPANY, Houston, TX (US)

(72) Inventors: David Paul Brisco, Duncan, OK (US); Walter Stam, Rijswijk (NL); Antonius Leonardus Maria Wubben, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 139 days.

(21) Appl. No.: 15/503,086

(22) PCT Filed: Aug. 10, 2015

(86) PCT No.: PCT/EP2015/068373

§ 371 (c)(1),
(2) Date: Feb. 10, 2017

(87) PCT Pub. No.: WO2016/023864

PCT Pub. Date: Feb. 18, 2016

(65) Prior Publication Data

US 2017/0226828 A1 Aug. 10, 2017

(30) Foreign Application Priority Data

Aug. 13, 2014 (EP) ..... 14180767

(51) Int. Cl.
*E21B 43/10* (2006.01)
*E21B 7/20* (2006.01)

(52) U.S. Cl.
CPC ..... *E21B 43/103* (2013.01); *E21B 7/20* (2013.01); *E21B 43/105* (2013.01); *E21B 7/208* (2013.01); *E21B 43/10* (2013.01)

(58) Field of Classification Search
CPC ..... E21B 43/105
See application file for complete search history.

(56) References Cited

U.S. PATENT DOCUMENTS

| | | | |
|---|---|---|---|
| 5,667,011 | A | 9/1997 | Gill et al. |
| 5,901,789 | A | 5/1999 | Donnelly et al. |
| 5,960,895 | A | 10/1999 | Chevallier et al. |
| 5,984,568 | A | 11/1999 | Lohbeck |
| 6,070,671 | A | 6/2000 | Cumming et al. |
| 6,196,316 | B1 | 3/2001 | Bosma et al. |
| 6,253,846 | B1 | 7/2001 | Nazzai et al. |
| 6,253,850 | B1 | 7/2001 | Nazzai et al. |
| 6,273,634 | B1 | 8/2001 | Lohbeck |
| 6,315,040 | B1 | 11/2001 | Donnelly |

(Continued)

FOREIGN PATENT DOCUMENTS

| | | |
|---|---|---|
| EP | 0643795 | 12/1993 |
| EP | 0907822 | 1/1998 |

(Continued)

*Primary Examiner* — Waseem Moorad
*Assistant Examiner* — Theodore N Yao

(57) ABSTRACT

In an assembly for lowering and expanding a tubular element in a borehole on an expansion string, at least part of the weight of the tubular element is transmitted to the expansion string via an internal upset and a support protruding from an outer surface of the expansion string below the internal upset.

19 Claims, 4 Drawing Sheets

(56) References Cited

U.S. PATENT DOCUMENTS

| | | | |
|---|---|---|---|
| 6,328,113 | B1 | 12/2001 | Cook |
| 6,419,025 | B1 | 7/2002 | Lohbeck et al. |
| 6,431,282 | B1 | 8/2002 | Bosma et al. |
| 6,454,493 | B1 | 9/2002 | Lohbeck |
| 6,460,615 | B1 | 10/2002 | Heijnen |
| 6,470,966 | B2 | 10/2002 | Cook et al. |
| 6,497,289 | B1 | 12/2002 | Cook et al. |
| 6,557,640 | B1 | 5/2003 | Cook et al. |
| 6,561,227 | B2 | 5/2003 | Cook et al. |
| 6,564,875 | B1 | 5/2003 | Bullock |
| 6,568,471 | B1 | 5/2003 | Cook et al. |
| 6,575,250 | B1 | 6/2003 | Wijsman |
| 6,604,763 | B1 | 8/2003 | Cook et al. |
| 6,607,046 | B1 | 8/2003 | Betts et al. |
| 6,631,760 | B2 | 10/2003 | Cook et al. |
| 6,634,431 | B2 | 10/2003 | Cook et al. |
| 6,640,903 | B1 | 11/2003 | Cook et al. |
| 6,684,947 | B2 | 2/2004 | Cook et al. |
| 6,907,652 | B1 | 6/2005 | Heijnen |
| 6,966,370 | B2 | 11/2005 | Cook et al. |
| 7,048,067 | B1 | 5/2006 | Cook et al. |
| 7,152,673 | B2 | 12/2006 | Lohbeck |
| 7,357,188 | B1 | 4/2008 | Cook et al. |
| 7,475,723 | B2 | 1/2009 | Ring et al. |
| 7,730,965 | B2 | 6/2010 | Jordan et al. |
| 2004/0216891 | A1 | 11/2004 | Maguire |
| 2005/0028987 | A1* | 2/2005 | Watson ..... E21B 43/103 166/380 |
| 2006/0065403 | A1 | 3/2006 | Watson et al. |
| 2007/0227730 | A1* | 10/2007 | Brisco ..... E21B 43/103 166/277 |
| 2009/0139732 | A1 | 6/2009 | Garcia |
| 2011/0094753 | A1* | 4/2011 | Whiddon ..... E21B 17/06 166/377 |
| 2012/0298379 | A1 | 11/2012 | Van Riet et al. |

FOREIGN PATENT DOCUMENTS

| | | |
|---|---|---|
| EP | 1044316 | 7/1999 |
| EP | 1149225 | 8/2000 |
| EP | 1169547 | 10/2000 |
| EP | 1073825 | 2/2001 |
| EP | 1080296 | 3/2001 |
| EP | 1268115 | 1/2003 |
| EP | 1717411 | 11/2006 |
| GB | 2368865 | 1/1998 |
| GB | 2347950 | 8/2003 |
| WO | 200118353 | 3/2001 |
| WO | 2010120523 | 10/2010 |
| WO | 2012104257 | 8/2012 |
| WO | 20140151314 | 9/2014 |

* cited by examiner

ASSEMBLY AND METHOD FOR CREATING AN EXPANDED TUBULAR ELEMENT IN A BOREHOLE

CROSS REFERENCE TO EARLIER APPLICATIONS

The present application is a National Stage application of PCT/EP2015/068373 filed on Aug. 10, 2015, which claims priority of European application No. 14180767.7 filed Aug. 13, 2014.

BACKGROUND OF THE INVENTION

The present invention relates to an assembly and a method for creating an expanded tubular element in a borehole. The borehole may extend into an earth formation, for instance for the exploration or production of hydrocarbons.

Wellbores for the production of hydrocarbons are generally provided with steel casings and/or liners to provide stability to the wellbore wall and to prevent uncontrolled flow of fluid between the wellbore and the surrounding earth formation. A casing generally extends from surface into the wellbore, whereas a liner may extend only a lower portion of the wellbore. However in the present description the terms "casing" and "liner" are used interchangeably and without such intended difference.

In a conventional wellbore, the wellbore is drilled in sections whereby each section is drilled using a drill string that has to be lowered into the wellbore through a previously installed casing. In view thereof the wellbore and the subsequent casing sections decrease in diameter with depth. The production zone of the wellbore therefore has a relatively small diameter in comparison to the upper portion of the wellbore. In view thereof it has been proposed to drill a "mono diameter" wellbore whereby the casing or liner to be installed is radially expanded in the wellbore below a previous casing, after lowering to the required depth. Subsequent wellbore sections may than be provided with expandable liners, wherein each liner is expanded to substantially the same inner diameter as the previous liner or casing. If subsequent liner sections are expanded to the same diameter as the previous section, the wellbore inner diameter may remain substantially constant along at least a part of its length.

Subsequent wellbore section may therefore be drilled at a diameter larger than in the conventional wellbore, which may allow the wellbore to have a larger inner diameter at target depth than a conventional wellbore.

US-2006/0065403-A1 discloses an assembly for expanding a tubular element in a wellbore, whereby the tubular element is suspended during running-in into the wellbore on an expansion string having an expander at its downhole end, and whereby the tubular element passes through an existing casing in the wellbore. There is a risk that the lower end of the tubular element is prematurely expanded by the expander, for example if the weight of the tubular element causes the tubular element to slip downward relative to the expansion string and consequently partly expand. Such unintended expansion may hamper, or even prevent, introduction of the tubular element through the existing casing.

US patent application US2009/0139732 discloses a downhole swaging system with an expandable secondary swage, which is expanded if a primary swage encounters an increased resistance to swaging generated by a load ring or a section of increased thickness or strength of the expandable tubular. The known load ring or section of increased resistance are located at a location along the length of the expandable tubular where the secondary swage needs to be expanded and they are not arranged at a lower end or the expandable tubular and do not support the expandable tubular during descend into a borehole prior to the expansion process.

Other downhole well tubular expansion systems are disclosed in US patent applications US2009/139732 and US2012/298379, International patent applications WO2012/104257 and WO2014/151314 and in European patent application EP 1717411.

These known assemblies are not provided with a starter joint. There is a need for an improved assembly for supporting and expanding a expandable tubular wherein the expansion string may be locked to a starter joint during transport to the rig and during make-up of the tubular element on the rig floor, which starter joint transfers the weight of the tubular element to the expansion string without the tubular element being prematurely expanded, and may furthermore transfer rotary torque from the expansion string to the tubular element required for making-up and breaking-out of the on-off sub connection and for reaming with the expansion assembly while running into the borehole and which may also transfer a downward force from the expansion string to the tubular element to enable the tubular element to be pushed into the borehole in case obstructions are encountered on the way down.

It is an object of the invention to provide an improved assembly for lowering and expanding a tubular element in a borehole.

SUMMARY OF THE INVENTION

The invention provides an assembly for lowering and expanding a tubular element in a borehole, the assembly comprising:

- an expander arranged at a downhole end of an expansion string for radially expanding the tubular element in the borehole by upward movement of the expansion string through the tubular element;
- a starter section arranged at a downhole end of the tubular element and comprising an internal upset having an upset inner diameter smaller than the initial inner diameter of the unexpanded tubular element; and
- support means protruding from an outer surface of the expansion string below the internal upset for supporting the internal upset of the starter section to transmit at least part of the weight of the unexpanded tubular element via the internal upset and the support means to the expansion string when the assembly is lowered into the borehole, the internal upset being adapted to be radially expanded by the support means upon upward movement of the expander through the tubular element.

The invention also relates to a method for lowering and expanding a tubular element in a borehole, the method comprising the steps of:

- arranging a starter section at a downhole end of the tubular element, the starter section comprising an internal upset having an upset inner diameter smaller than the initial inner diameter of the unexpanded tubular element;
- arranging an expansion string extending within the tubular element, the expansion string comprising an expander for radially expanding the tubular element in the borehole by upward movement of the expander through the tubular element and support means protruding from an outer surface of the expansion string below the internal upset for supporting the internal upset;

lowering the assembly into a borehole while transmitting at least a portion of the weight of the tubular element via the internal upset and the support means to the expansion string; and radially expanding the internal upset by the support means upon upward movement of the expander through the tubular element.

BRIEF DESCRIPTION OF THE DRAWINGS

The invention will be described hereinafter in more detail and by way of example with reference to the accompanying schematic drawings in which.

In the detailed description and the figures, like reference numerals relate to like components.

DETAILED DESCRIPTION OF DEPICTED EMBODIMENTS

Figure 1:
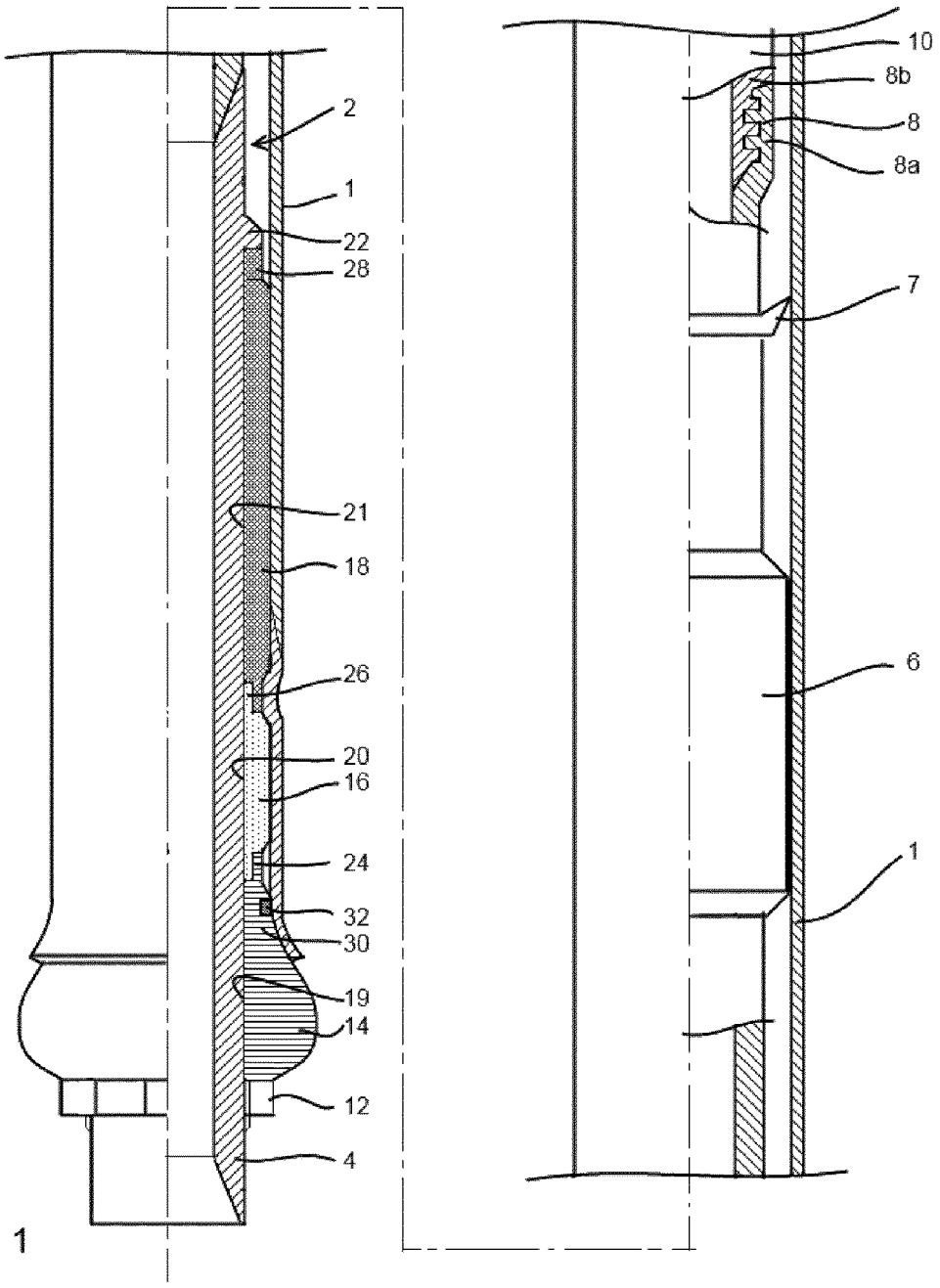
FIG. 1 shows an exemplary embodiment of the assembly according to an embodiment of the invention.

The present disclosure involves an assembly for lowering and expanding a tubular element in a borehole on an expansion string, wherein at least part of the weight of the tubular element is transmitted to the expansion string via an internal upset and support means.

The weight carrying capacity of the expansion string is increased by virtue of the support means and the internal upset cooperating to carry at least a portion of the weight of the tubular element. The internal upset is expanded itself at the onset of the expansion process and thereby does not form an obstruction in the tubular element as expansion proceeds.

To allow the support means to pass easily through the unexpanded tubular element during the expansion process, suitably the support means has an outer diameter substantially equal to an inner diameter of the tubular element prior to radial expansion thereof, the support means being arranged upwardly from the expander.

To promote radial expansion of the internal upset by the support means, the internal upset advantageously rests on a support surface of the support means, the support surface extending inclined relative to a longitudinal axis of the expansion string.

The tubular element may be supported by a starter section during descent into the borehole. The starter section may take the form of a starter joint. The starter joint may overcome other drawbacks of the prior art as well.

In an exemplary embodiment, the support means comprises a series of external splines provided to the expansion string, the external splines being arranged to cooperate with a series of internal splines provided to the starter section to form a splined connection that rotationally locks the expansion string to the starter section.

To further increase the weight carrying capacity of the expansion string, the internal splines may be supported by an upper portion of the expander.

Suitably the expansion string includes a mandrel and a torque retainer ring extending around the mandrel, wherein the external splines are provided to the torque retainer ring.

The internal upset may comprise, for example, an annular internal upset extending along the inner circumference of the tubular element. Furthermore, the annular internal upset may extend into an annular recess formed in the expansion string so as to allow the tubular element to be pushed in downward direction by the expansion string.

Suitably the expansion string comprises a near-cone centralizer for centralising the expansion string in the tubular element, wherein a lower portion of the near-cone centralizer defines a boundary of the annular recess. The expansion string further may comprise a far-cone centralizer for centralising the expansion string in the tubular element, the far-cone centralizer being arranged upwardly from the near-cone centralizer. A debris catcher may be arranged at an upper portion of the expansion string.

In an exemplary embodiment the expansion string is at the upper end thereof connected to a drill pipe by means of an on-off sub that is adapted to be disconnected by rotation of the drill pipe relative to the expansion mandrel.

The starter section suitably comprises a lower section of the tubular element, said lower section being connected to an upper section of the tubular element in releasable manner In order to anchor the tubular element after expansion thereof against another tubular element in the borehole, the starter section may be provided at its outer surface with a layer of friction material for enhancing friction between the starter section and the other tubular element.

Suitably the starter section comprises an outwardly flaring lower part arranged to be supported by the expander so as to transmit another portion of the weight of the tubular element via the outwardly flaring lower part and the expander to the expansion string. In this manner the weight carrying capacity of the assembly may be enhanced.

In order to further reduce the risk of premature expansion of the tubular element, the outwardly flaring lower part of the starter section may comprise a material of higher yield strength than a material of a remainder part of the starter section. Suitably the tubular element after radial expansion thereof forms an expanded liner or an expanded casing in the borehole.

FIG. 1 shows an assembly including a tubular element 1 adapted to be radially expanded in a wellbore and an expansion string 2 for radially expanding the tubular element. The expansion string 2 may comprise a mandrel 4, a far-cone centralizer 6, a debris catcher 7 and an on-off sub 8 having lower and upper parts 8*a*, 8*b*. The on-off sub 8 connects the expansion string to the lower end of a drill pipe 10, and may be adapted to be disconnected by rotation of the drill pipe 10 relative to the mandrel 4. Expander 14 for expanding the tubular element 1 is arranged near a downhole end of the expansion string 2.

The mandrel 4 may be provided with a lock nut 12, the expander in the form of expansion cone 14, a torque retainer ring 16 and a near-cone centralizer 18. Each of the expansion cone 14, the torque retainer ring 16 and the near-cone centralizer 18 has a respective central passage 19, 20, 21 through which the mandrel 4 extends in slidable manner. The lock nut 12 is screwed to the mandrel 4 to lock the assembly of expansion cone 14, torque retainer ring 16 and near-cone centralizer 18 in place whereby the near-cone centralizer abuts against a shoulder 22 of the mandrel 4. The expansion cone 14 may be rotationally locked to the torque retainer ring 16 by a castellated connection 24. The torque retainer ring 16 may be rotationally locked to the near-cone centralizer 18 by a castellated connection 26. The near-cone centralizer 18 may be rotationally locked to the shoulder 22 of mandrel 4 by a castellated connection 28.

Alternatively the torque retainer ring 16 may be directly rotationally locked to the mandrel 4 by means of key slots in the torque retainer ring 16 and the mandrel 4, and keys fitting in such key slots. This way the castellated connections 26, 28 may be eliminated.

The expansion cone 14 has a nose portion 30 of diameter substantially equal to the inner diameter of the unexpanded tubular element 1. From the nose portion 30, the diameter of the expansion cone 14 gradually increases in downward direction to a diameter corresponding to a desired expansion ratio of the tubular element 1. The nose portion 30 is provided with an annular seal 32 of resilient material.

Figure 2A:
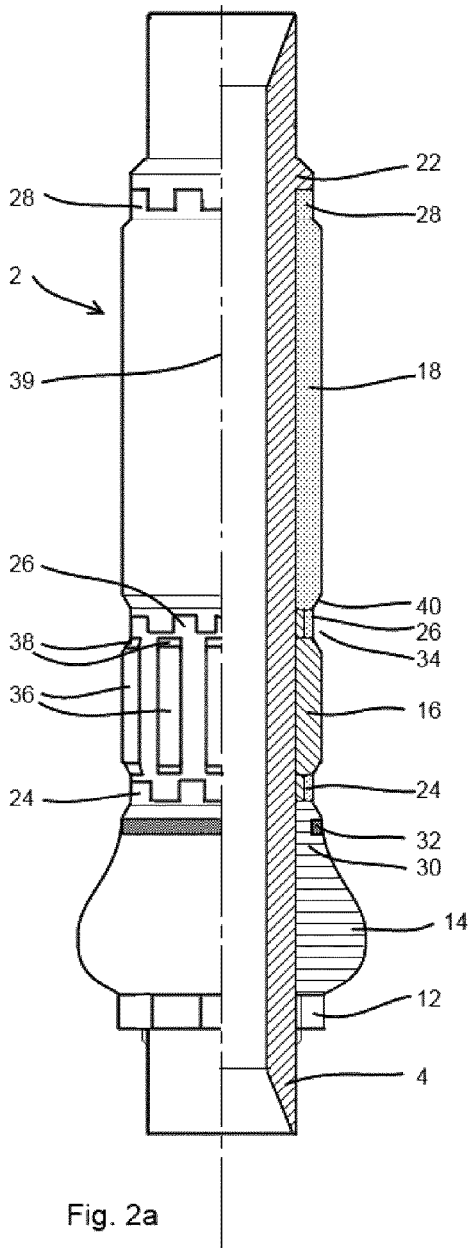
FIG. 2*a* shows a portion of an expansion string of the exemplary embodiment.

FIG. 2*a* shows the mandrel 4 with related components in more detail. An annular recess 34 may be formed between the torque retainer ring 16 and the near-cone centralizer 18, for instance at the level of the castellated connection 26. The torque retainer ring 16 may be provided with a series of external splines 36 regularly spaced along the outer circumference of the torque retainer ring. Each external spline 36 may have an upper surface 38 extending inclined relative to a longitudinal axis 39 of the mandrel 4. The respective upper surfaces 38 define the lower boundary of the annular recess 34. The upper boundary of the annular recess 34 is defined by a tapered lower surface 40 of the near-cone centralizer 18.

Figure 2B:
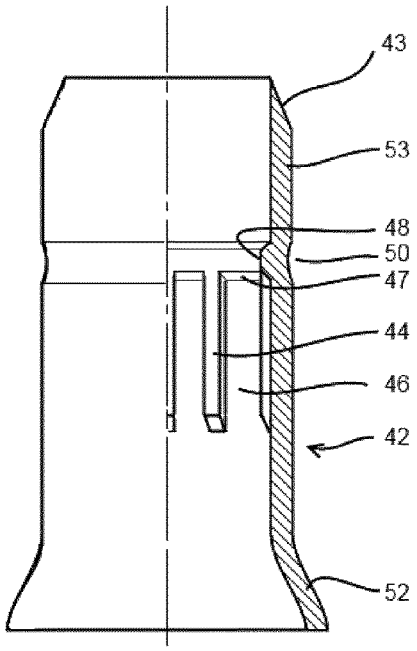
FIG. 2*b* shows a starter joint of the exemplary embodiment.

FIG. 2*b* shows a starter section of the tubular element 1 in the form of starter joint 42. The starter joint 42 may form a lower portion of the tubular element 1. The starter joint 42 may for instance be adapted to be connected to an upper portion of the tubular element 1 (not shown) by pin member 43. The pin member may be a male part of a threaded connection, connectable to a corresponding box member of the upper portion of the tubular element.

The starter joint 42 may be provided with a series of internal splines 44 regularly spaced along the inner circumference of the starter joint 42. Slots 46 may be defined between the respective internal splines 44. The slots 46 are arranged to receive the external splines 36 of the torque retainer ring 16 so as to form a splined connection. Each slot 46 has an upper surface 47 extending at the same inclination as the upper surfaces 38 of the external splines 36.

The starter joint 42 may be provided with an annular internal upset 48 that fits into the annular recess 34. The lower boundary of the internal upset 48 is formed by the respective upper surfaces 47 of the slots 46. An annular indentation 50 is formed in the outer surface of the starter joint 42 at the level of the internal upset 48 so that the wall thickness of the starter joint 42 remains substantially constant along its length.

In an embodiment, the starter joint 42 has an outwardly flaring lower section 52 adapted to receive an upper part of the expansion cone 14, as shown in FIG. 1. The largest outer diameter of the lower section 52 is less than, or equal to, the largest outer diameter of the expansion cone 14. Also, the starter joint 42 may have an upper section 53 of inner diameter substantially equal to an initial inner diameter of the tubular element 1 prior to expansion thereof.

During operation, the starter joint 42 may be made-up with the expansion string 2 as follows. The near-cone centralizer 18 is fitted to the mandrel 4 so that the near-cone centralizer 18 abuts against shoulder 22 and is rotationally locked to the mandrel 4 by castellated connection 28. Then the upper portion 53 of the starter joint 42 is extended over the near-cone centralizer 18 until the annular internal upset 48 contacts the tapered lower surface 40 of the near-cone centralizer 18. Subsequently the torque retainer ring 16 is inserted into the starter joint 42 such that the external splines 36 slide into the slots 46 of the starter joint 42 until the upper surfaces 38 of the external splines 36 abut against the annular internal upset 48. In this position the torque retainer ring 16 is rotationally locked to the near-cone centralizer 18 by castellated connection 26.

Subsequently the expansion cone 14 is inserted into the starter joint 42 and fitted to the mandrel 4 until the nose portion 30 of the expansion cone 14 abuts against the torque retainer ring 16. In this position the expansion cone 14 is rotationally locked to the torque retainer ring 16 by castellated connection 24. Then the lock nut 12 is screwed to the mandrel 4 so as to axially lock the expansion cone 14, the torque retainer ring 16 and the near-cone centralizer 18 to the mandrel 4. The length of the internal splines 44 is such that these abut against the nose portion 30 of the expansion cone 14 after the lock nut 12 has been fastened. Subsequently the mandrel 4 is connected to the far-cone centralizer 6, the debris catcher 7 and the lower part 8*a* of the on-off sub 8 as shown in FIG. 1. Finally a joint of the tubular element 1 is connected to the pin member 43 of the starter section. The internal upset 48 prevents the expansion string 2 from dropping out of the tubular element and starter joint 42 during this phase.

In a next step the expansion string 2 is lowered into the wellbore whereby the remaining upper portion of the tubular element is formed by adding tubular sections to the tubular element 1 in correspondence with the total length of the tubular element required in the wellbore. Meanwhile the tubular element 1 is supported and locked against rotation by a support device (not shown) at a drilling rig above the wellbore.

Subsequently upper part 8*b* of the on-off sub 8 may be connected to the bottom of drill pipe 10. Sections of drill pipe are added to form drill pipe 10. The drill pipe 10 is lowered into the tubular. Then the on-off sub 8 is made-up, for instance through right-hand rotation of the drill pipe sections. Upon lifting up the assembly on the drill pipes, the top of the tubular element 1 is released from the support device.

Subsequently the tubular assembly is run into the wellbore by adding drill pipes in correspondence with the depth of the wellbore. During running-in the assembly into the wellbore the weight of the tubular element 1 is transferred to the expansion string 2 via the contact between the internal upset 48 and the external splines 36, via the contact between the internal splines 44 and the nose portion 30 of the expansion cone 14, and via the contact between outwardly flaring lower portion 52 of the starter joint 42 and the expansion cone 14.

Rotary torque required for making-up the on-off sub 8, or for reaming the wellbore while running the assembly into the wellbore, is transferred from the mandrel 4 via the castellated connection 28 to the near-cone centralizer 18, then via the castellated connection 26 to the torque retainer ring 16, then via the splined connection to the starter joint 42, and then via the pin member 43 and the corresponding box member to the remaining upper portion of the tubular element 1.

If the expansion cone 14 may get stuck in the tubular element 1 during the expansion process, for example while the expansion cone is located in an overlap section wherein the tubular element 1 overlaps a previous liner or casing, the drill pipe may be disconnected from the expansion string 2 by breaking out the on-off sub. At this stage the external splines 36 of the torque retainer ring 16 may no longer be in contact with the internal splines 44 of the starter joint 42. In such instance the break-out torque for breaking out the on-off sub is transmitted from the drill pipe via the on-off sub to the mandrel 4, then via the castellated connections 28, 26, 24 to the expansion cone 14, and finally via the face of the expansion cone 14 to the tubular element 1.

If the tubular element needs to be pushed in downward direction to overcome friction between the tubular element 1 and the wellbore wall, for example during running-in the expansion assembly into a high inclination borehole, the required downward force is transmitted from the drill pipe and mandrel 4 via the near-cone centralizer 18 to the annular internal upset 48 of the starter joint 42 and hence to the stuck point of the tubular element 1.

Once the expansion assembly has reached the target depth in the wellbore, the expansion process is started by applying a selected upward force to the drill pipe to move the expansion string 2 upwardly while the tubular element 1 is held stationary, for example by anchoring the tubular element 1 to another tubular element arranged in the wellbore. In this manner the external splines 36 of the torque retainer ring 16 expand the internal upset 48 of the starter joint 42 until the internal upset becomes flush with the outer diameter of the nose portion 30 of the expansion cone 14. The inclined upper surfaces 38 of the external splines 36 and the correspondingly inclined upper surfaces 47 of the slots 46 induce the onset of expanding the internal upset. Simultaneously, the expansion cone 14 expands the lower section 52 of the starter joint 42 followed by the splined portion of the starter joint, and subsequently the remainder of the tubular element 1.

In view of the relatively high local contact stresses that may occur between the expansion cone 14 and the edges of the internal splines 44 during expansion, the inner surface of the starter joint 42 may be provided with a dedicated coating, for instance a solid lubricant. A suitable example of such coating is Manganese Phosphate overlayed by a layer of a teflon based material, for example Xylan™ coating. A solids free coating, e.g. Rust Preventing Solid Lubricant film, may be used in combination with such coating.

The load carrying capacity of the starter joint 42 is selected such that the force required to release the expansion string 2 from the starter joint 42 exceeds the buoyant weight of the tubular element 1 in a vertical borehole. In this manner premature plastic deformation of the starter joint 42 is prevented. Such premature plastic deformation could otherwise result in an increase of the maximum diameter of the lower section 52 of the starter joint 42 to the extent that the starter joint 42 cannot pass through another tubular element already installed in the wellbore.

Figure 3:
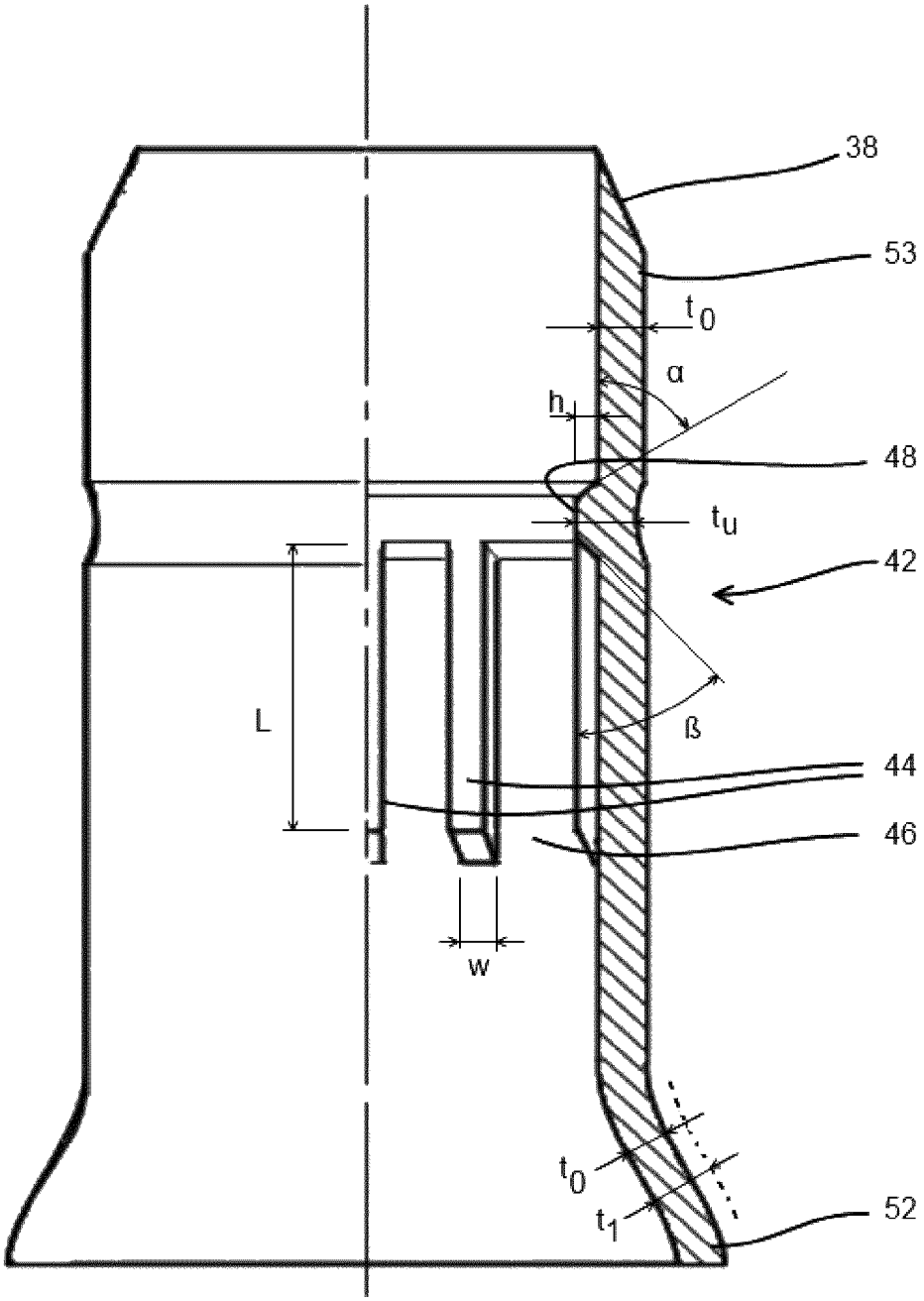
FIG. 3 shows the starter joint with some design parameters indicated.

FIG. 3 indicates some design parameters that may be used to achieve the required minimum force to release the expansion string 2 from the starter joint 42. The starter joint 42 has a reference wall thickness $t_0$ substantially equal to that of the remainder of the tubular element 1. The started joint may be manufactured from the same expandable material as the remainder of the tubular element 1.

A suitale material may be for example VM-50 expandable tubular, marketed by Vallourec (France). VM 50 P110 is nickel based, and made of an austenitic Corrosion Resistant Alloy. The main alloying elements may be 54% Ni, 20% Cr and 9% Mo.

The push-down force capability, i.e. the capability of pushing the tubular element 1 downwardly via the expansion string 2, is dependent on the dimensions of the internal upset 48: h, $t_u$ and $\alpha$. The rotational torque transmission capability via the splined connection is dependent on the dimensions of the splines: l, w and h. The weight carrying capacity of the starter joint 42 is dependent on the dimensions of the internal upset 48: h, ß, the cross-sectional area and number of external and internal splines 36, 44, and the maximum diameter of the lower section 52 of the starter joint.

Furthermore, the friction factor at the interface between the expansion cone 14 and the lower section 52 can be increased to increase the weight carrying capacity, for example by application of a high-friction copper coating at the interface.

The weight carrying capacity obtained by the internal upset 48, the splines 36, 44 and the lower section 52 enables a maximum length of the tubular element 1 to be carried into the wellbore whereby the buoyant weight of the tubular element in a vertical hole is less than the expansion force required to expand the tubular element 1.

A safety margin may be applied to compensate for variations in friction factor at the interface between the expansion cone 14 and the lower section 52 of the starter joint 42, and to compensate for reduction of the material yield strength with increasing temperature. The length of tubular element that may be run into the wellbore with the starter joint 42 may be up to 3500 ft (1067 m).

The load carrying capacity of the starter joint 42 may be increased in the following ways:

- increase the wall thickness $t_u$ at the internal upset 48;
- increase the wall thickness of the outwardly flaring lower section 52 from $t_0$ to $t_1$;
- increase the yield grade of the material of the outwardly flaring lower section 52 from e.g. steel grade 50 to an expandable steel grade 80, which may be combined with an increased wall thickness of lower section 52. The latter may be butt welded to the remaining portion of the starter joint 42.

A combination of the above measures may result in an increase of the load carrying capacity of the starter joint 42 of about 100% or more. The invention may thus enable for instance about 7000 ft (2134 m) of expandable tubular element to be run into the borehole in a controlled way in a single trip.

The above design modifications may result in a significantly increased peak expansion force of the starter joint relative to the load carrying capacity, which may put a high demand on the pulling capacity of the drilling rig. To mitigate this effect the wall thickness of a section of the starter joint just above the outwardly flaring lower section 52 may be reduced.

Figure 4:
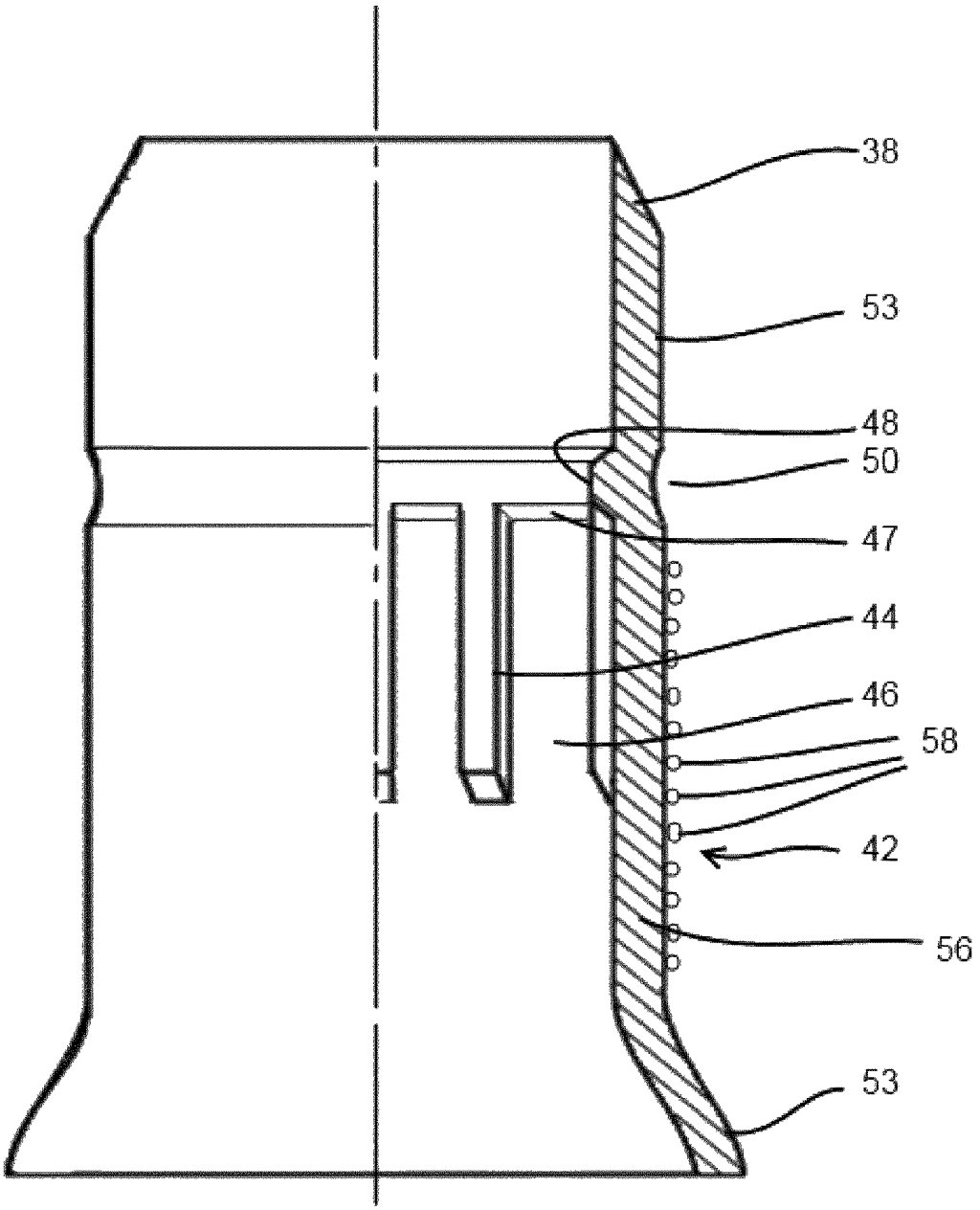
FIG. 4 shows a modified version of the starter joint.

Referring to FIG. 4, the starter joint 42 also may be used for cladding of a host casing in a wellbore. The host casing may for example be a conventional casing or an already expanded casing. Cladding the existing casing may increase the collapse rating of the host casing. In such application, a constant wall thickness of the starter joint may be required in order to provide a constant support to the host casing and to control the peak expansion force.

The starter joint 42 may also function to anchor the expanded tubular element to the host casing. Thus, the expanded starter joint will form a cased hole anchor, i.e. an anchor for anchoring the expanded tubular element to the casing of the cased borehole. This can be achieved by providing cylindrical section 56 of the starter joint 42 with a high friction layer 58. For this purpose carbide particles may be used that may be brazed or laser-coated to the outer surface of cylindrical section 56. Alternatively small ceramic ball may be partly pressed into the wall of cylindrical section 56. Such cased hole anchor provides a very effective means of anchoring the expanded tubular element to the host casing and allows the remainder of the tubular element to be expanded by rig overpull.

With the assembly described herein it may be achieved that the expansion string is locked to the starter joint during transport to the rig and during make-up of the tubular element on the rig floor. Further, the starter joint transfers the weight of the tubular element to the expansion string without the tubular element being prematurely expanded, and transfers rotary torque from the expansion string to the tubular element required for making-up and breaking-out of the on-off sub connection and for reaming with the expansion assembly while running into the borehole. Also, the starter joint transfers a downward force from the expansion string to the tubular element to enable the tubular element to be pushed into the borehole in case obstructions are encountered on the way down.

The present invention is not limited to the embodiments thereof described above, wherein many modifications are conceivable within the scope of the appended claims. Features of respective embodiments may for instance be combined.

We claim:

1. An assembly for lowering and expanding a tubular element in a borehole, the assembly comprising:

a starter section arranged at a downhole end of the tubular element and comprising an internal upset having an upset inner diameter smaller than an initial inner diameter of the unexpanded tubular element;

an expander arranged at a downhole end of an expansion string for radially expanding the tubular element in the borehole by upward movement of the expansion string through the tubular element; and support means protruding from an outer surface of the expansion string below the internal upset, wherein the support means support the internal upset of the starter section to transmit at least part of the weight of the unexpanded tubular element via the internal upset and the support means to the expansion string when the assembly is lowered into the borehole, the internal upset being adapted to be radially expanded by the support means upon upward movement of the expander through the tubular element.

2. The assembly of claim 1, wherein the support means have an outer diameter smaller than, or equal to, the initial inner diameter of the tubular element, the support means being arranged upwardly from the expander.

3. The assembly of claim 1, wherein the internal upset rests on a support surface of the support means, the support surface extending inclined relative to a longitudinal axis of the expansion string to promote radial expansion of the internal upset by the support means.

4. The assembly of claim 1, wherein the support means comprise a series of external splines, the external splines being arranged to cooperate with a series of internal splines provided on an inner surface of the starter section to form a splined connection that rotationally locks the expansion string to the starter section.

5. The assembly of claim 4, wherein the internal splines are supported by an upper portion of the expander.

6. The assembly of claim 1, wherein the internal upset comprises an annular internal upset extending along the inner circumference of the starter section.

7. The assembly of claim 6, wherein the annular internal upset extends into an annular recess formed in the expansion string to allow the tubular element to be pushed in downward direction by the expansion string.

8. The assembly of claim 7, the expansion string comprising a near-cone centralizer for centralising the expansion string in the tubular element, a lower portion of the near-cone centralizer defining a boundary of the annular recess.

9. The assembly of claim 8, the expansion string comprising a far-cone centralizer for centralising the expansion string in the tubular element, the far-cone centralizer being arranged upwardly with respect to the near-cone centralizer.

10. The assembly of claim 1, wherein the expansion string comprises a debris catcher arranged at an upper portion of the expansion string.

11. The assembly of claim 1, the starter section being connected to the tubular element in releasable manner.

12. The assembly of claim 1, wherein an outer surface of the starter section is provided with a layer of friction material for increasing friction between the starter section and another tubular element enclosing the starter section.

13. The assembly of claim 1, the starter section comprising an outwardly flaring lower part supported by the expander to transmit another portion of the weight of the tubular element via the outwardly flaring lower part and the expander to the expansion string, wherein the outwardly flaring lower part of the starter section comprising a material of higher yield strength than a material of a remainder part of the starter section.

14. A method for lowering and expanding a tubular element in a borehole, the method comprising the steps of:

arranging a starter section at a downhole end of the tubular element, the starter section comprising an internal upset having an upset inner diameter smaller than an initial inner diameter of the unexpanded tubular element;

arranging within the tubular element an expansion string comprising an expander for radially expanding the tubular element in the borehole by upward movement of the expander through the tubular element and support means protruding from an outer surface of the expansion string below the internal upset for supporting the internal upset;

lowering the assembly into the borehole while transmitting at least a portion of the weight of the unexpanded tubular element via the internal upset and the support means to the expansion string; and subsequently radially expanding the internal upset by the support means upon upward movement of the expander through the tubular element.

15. The method of claim 14, further comprising the step of rotationally locking the expansion string to the starter section by means of a splined connection including a series of external splines provided to the support means and a series of internal splines provided to the starter section.

16. The method of claim 14, wherein the internal upset comprises an annular internal upset extending along the inner circumference of the starter section.

17. The method of claim 16, wherein the annular internal upset extends into an annular recess formed in the expansion string to allow the tubular element to be pushed in downward direction by the expansion string.

18. The method of claim 17, the expansion string comprising a near-cone centralizer for centralising the expansion string in the tubular element, a lower portion of the near-cone centralizer defining a boundary of the annular recess.

19. The method of claim 18, the expansion string comprising a far-cone centralizer for centralising the expansion string in the tubular element, the far-cone centralizer being arranged upwardly with respect to the near-cone centralizer.

* * * * *